US011674650B2

(12) United States Patent
Vissenberg et al.

(10) Patent No.: US 11,674,650 B2
(45) Date of Patent: Jun. 13, 2023

(54) LIGHT EMITTING DEVICE

(71) Applicant: SIGNIFY HOLDING B.V., Eindhoven (NL)

(72) Inventors: Michel Cornelis Joseph Marie Vissenberg, Roermond (NL); Johannes Petrus Maria Ansems, Hulsel (NL); Malgorzata Perz, Eindhoven (NL); Dragan Sekulovski, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/442,548

(22) PCT Filed: Mar. 23, 2020

(86) PCT No.: PCT/EP2020/057992
§ 371 (c)(1),
(2) Date: Sep. 23, 2021

(87) PCT Pub. No.: WO2020/193476
PCT Pub. Date: Oct. 1, 2020

(65) Prior Publication Data

US 2022/0170601 A1 Jun. 2, 2022

(30) Foreign Application Priority Data

Mar. 26, 2019 (EP) ..... EP19165073

(51) Int. Cl.

| | |
|---|---|
| ***F21S 8/02*** | (2006.01) |
| ***F21V 7/00*** | (2006.01) |
| ***F21Y 115/10*** | (2016.01) |

(52) U.S. Cl.
CPC ..... *F21S 8/026* (2013.01); *F21V 7/0091* (2013.01); *F21Y 2115/10* (2016.08)

(58) Field of Classification Search
CPC ..... F21S 8/026; F21V 7/0091; F21Y 2115/10
(Continued)

(56) References Cited

U.S. PATENT DOCUMENTS

| | | | |
|---|---|---|---|
| 3,200,280 | A | 8/1965 | Marcus et al. |
| 4,764,707 | A | 8/1988 | Cheng |

(Continued)

FOREIGN PATENT DOCUMENTS

| | | | |
|---|---|---|---|
| CN | 201228892 | Y | 4/2009 |
| JP | 2004134196 | A | 4/2004 |

(Continued)

*Primary Examiner* — Andrew J Coughlin
*Assistant Examiner* — Jessica M Apenteng

(57) ABSTRACT

A light emitting device (1) comprising a light exit surface (41) and at least one light source (5) configured to, in operation, emit light, wherein the light emitting device is configured to provide a light output at the light exit surface (41), the light output comprising at least one peak intensity in a first direction (A) and an intensity cut-off in at least one second direction (B), where the intensity in the at least one second direction (B) is less than 10 % of the peak intensity in the first direction (A), and wherein the light emitting device (1) comprises a plurality of sparkling elements (6) arranged in the optical path of at least a part of the light emitted by the at least one light source (5), at least two sparkling elements of the plurality of sparkling elements (6) being configured and arranged to be visible when observed from a viewing position corresponding to the at least one second direction (B).

11 Claims, 3 Drawing Sheets

(58) Field of Classification Search
USPC ..... 362/145
See application file for complete search history.

(56) References Cited

U.S. PATENT DOCUMENTS

| | | | | |
|---|---|---|---|---|
| 5,662,403 | A | 9/1997 | Akashi et al. | |
| 6,808,293 | B2 | 10/2004 | Watanabe et al. | |
| 8,033,691 | B2 | 10/2011 | Bierhuizen et al. | |
| 8,292,471 | B2 | 10/2012 | Boonekamp et al. | |
| 8,820,962 | B2 | 9/2014 | Kang | |
| 9,074,746 | B2 | 7/2015 | Rice et al. | |
| 9,423,089 | B2 | 8/2016 | Lee | |
| 2010/0246176 | A1 | 9/2010 | Shyu et al. | |
| 2010/0259153 | A1* | 10/2010 | Futami ..... | F21S 43/247<br>313/114 |
| 2011/0249467 | A1 | 10/2011 | Boonekamp | |
| 2013/0063961 | A1* | 3/2013 | Yamazaki ..... | F21S 43/26<br>362/521 |
| 2013/0083551 | A1* | 4/2013 | Watanabe ..... | F21S 43/20<br>362/516 |
| 2015/0070901 | A1 | 3/2015 | Rich et al. | |

FOREIGN PATENT DOCUMENTS

| | | | |
|---|---|---|---|
| JP | 2013157618 | A | 8/2013 |
| WO | 2013190979 | A1 | 12/2013 |

* cited by examiner

LIGHT EMITTING DEVICE

CROSS-REFERENCE TO PRIOR APPLICATIONS

This application is the U.S. National Phase application under 35 U.S.C. § 371 of International Application No. PCT/EP2020/057992, filed on Mar. 23, 2020, which claims the benefit of European Patent Application No. 19165073.8, filed on Mar. 26, 2019. These applications are hereby incorporated by reference herein.

FIELD OF THE INVENTION

The invention concerns directional light emitting devices. More particularly, the invention concerns a light emitting device comprising a light exit surface and at least one light source configured to, in operation, emit light, the light emitting device being configured to provide a light output at the light exit surface, the light output comprising at least one peak intensity in a first direction and an intensity cut-off in at least one second direction, where the intensity in the second direction is less than 10% of the peak intensity in the first direction.

BACKGROUND OF THE INVENTION

Directional light emitting devices are widely used in a variety of applications. For directional light emitting devices or highly directional luminaires, such as spot lamps, accent lighting luminaires and road lighting luminaires, the peak intensity is very high by design as the light needs to be focused in a certain direction. Ideally, the intensity should be zero when viewed from a direction other than the first direction. However, in practice there will still be some bright regions in the exit window of the light emitting device. For TIR optics and TIR Fresnel lenses such bright regions are most often located at the center part of the optical element of the light emitting device. For the free-shape lenses used in road lighting, and also not necessarily for reflector optics, such bright regions need not be located at the center part of the optical element of the light emitting device.

This unwanted brightness can be the cause of glare. More particularly, if an observer accidentally looks into such a light emitting device, they are inevitably blinded by the glare. When the observer is not looking into the beam, the observer may still be experiencing glare, here provided by two completely different mechanisms: 1) If the intensity distribution is not sharply cut-off, for instance by scattering or uncontrolled reflections inside the optics, etc., there may still be an uncomfortably high luminance in the direction outside of the beam. 2) If the intensity distribution is sharply cut-off, the observer does not notice the bright source (and is also not blinded by it) until the observer enters the beam and is "hit" by the extremely bright source. This is known as the so-called "smack" effect. This is particularly an issue when the pattern is repeated, like lighting poles along a road or tunnel lighting fixtures.

Thus, it is a problem that both a smooth and a sharp intensity cut-off may cause discomfort to the observer.

Many optical solutions to create a sparkling effect are known, where sparkling elements are created for aesthetic reasons. These known solutions include the use of structured coatings, asymmetrically reflecting particles, lenslet arrays, prismatic structures and reflector facets.

Generally, the boundaries between bright, glaring and sparkling luminous elements depend on the luminance and solid angle (angular extent of the bright element with respect to the eye of the observer, or $A/R^2$, where A is the projected area of the element as seen by the observer, and R is the observer distance). One solution employing this dependency is described in U.S. Pat. No. 5,662,403 A, which discloses a luminaire with a sparkling element that satisfies these conditions of luminance, size and typical viewing distance and viewing angle. If the element is too large and too bright, it will cause glare. If it is not bright or small enough, it causes neither glare nor sparkle (it is merely bright or even dim).

According to U.S. Pat. No. 5,662,403 A, the advantage of the sparkling element is an increase in perceived brightness of the space. The experimental details to support this claim show that this is indeed the case, but only in rather dark spaces. In brightly lit spaces, the effect of the sparkling element is to decrease the perceived brightness of the space. The present invention builds on this realization. Furthermore, it should be noted that the experiments referred to in U.S. Pat. No. 5,662,403 A were based on fluorescent lighting sources with a limited luminance up to a few times 10 kcd/m2. However, LED lighting can have peak luminance values of 10 Mcd/m2, i.e. a thousand times higher.

It is thus still needed and consequently desired to provide a light emitting device which solves the above problems in a satisfactory way, and which in case of a sharp intensity cut-off, the sparkly element(s) will give a warning to the observer that a bright element is about to enter the field of view and/or it will allow the observer to start to adapt to higher brightness before the glary source enters the field of view.

SUMMARY OF THE INVENTION

It is an object of the present invention to overcome these problems, and to provide a light emitting device with which the observer does not experience or experiences less discomfort when observing the light emitting device, irrespective of whether the light emitting device has a smooth or a sharp intensity cut-off.

It is a further object to provide a light emitting device with which in case of a sharp intensity cut-off, the sparkly element(s) will give a warning to the observer that a bright element is about to enter the field of view and/or it will allow the observer to start to adapt to higher brightness before the glary source enters the field of view.

According to a first aspect of the invention, this and other objects are achieved by means of a light emitting device comprising a light exit surface and at least one light source configured to, in operation, emit light, the light emitting device being configured to provide a light output at the light exit surface, the light output comprising at least one peak intensity in a first direction and an intensity cut-off in at least one second direction, wherein the intensity in the at least one second direction is less than 10% of the peak intensity in the first direction. The light emitting device comprises a plurality of sparkling elements arranged in the optical path of at least a part of the light emitted by the at least one light source. At least two sparkling elements of the plurality of sparkling elements are configured to be visible when observed from a viewing position corresponding to the at least one second direction. The plurality of sparkling elements covers less than 10% of the area of the light exit surface from which light with the peak intensity is emitted in operation of the light emitting device.

As used herein, the term "sparkling element" is intended to refer to an element being a small and bright element that is considered to be pleasing in the appreciation of the observer. An element has to be very small and bright to be sparkling. It is noted that any dynamics in the brightness, for instance with viewing angle or just by time varying brightness, enhances the sparkle perception, but that static elements may also be considered as being sparkly.

The invention builds on the realization that such sparkling elements are in fact not glary but sparkly, and thus that the addition of very bright elements close to the original (unwanted) bright element reduces the brightness perception and therefore the glare of this unwanted bright element. Thus, by adding to such a light emitting device, in the optical path of at least a part of the light emitted by the at least one light source, a plurality of sparkling elements configured and arranged to be visible when observed from a viewing position corresponding to the at least one second direction, the glare sensation otherwise sensed by an observer may be alleviated. Hence, with such a light emitting device the observer does not experience, or experiences less, discomfort when observing the light emitting device, irrespective of whether the light emitting device has a smooth or a sharp intensity cut-off.

Furthermore, the solution according to the invention is even applicable to light emitting devices where the brightness of the source is effectively cut off to zero outside of the first direction. Although such light emitting devices are usually considered to be of high quality, a sharply defined intensity cut-off can still cause discomfort because of the sudden transitions between the dark state (outside the beam) and an extremely bright state (inside the beam). Therefore, with such a light emitting device, the sparkly element(s) will give a warning to the observer that a bright element is about to enter the field of view and will allow the observer to start to adapt to higher brightness before the glary source enters the field of view.

Thus, the overall effect of adding the sparkling elements is to reduce the glare of the uncontrolled brightness of the directional lamp or luminaire, caused by imperfections or limitations in the optics of the product and at the same time to alleviate the "smack"-effect.

Furthermore, and particularly by ensuring that at least two sparkling elements of the plurality of sparkling elements are configured to be visible when observed from a viewing position corresponding to the at least one second direction, the above-mentioned advantages related to the observer of the light emitting device are obtained irrespective of the direction from which the observer views and moves closer to the light emitting device.

In an embodiment the plurality of sparkling elements is provided at, in or on the light exit surface.

Thereby, a light emitting device with a particularly simple structure is provided for.

In an embodiment the sparkling elements of the plurality of sparkling elements are any one or more of point like, linear or curved linear.

Providing sparkling elements shaped in such a way enhances the sparkle perception due to the fact that sparkling points tend to create a star shape in the lens of the eye or in a camera lens. Also, a further possibility of adding a decorative effect to the light emitting device, even in an off-state thereof, is thereby provided.

The applicant has conducted experiments on a light emitting device according to the invention under low and high ambient lighting conditions (2 cd/m$^2$ in the immediate surrounding of the sparkling element versus about 200 cd/m$^2$, which is comparable to a brightly lit room surface). In contrast with the results disclosed in U.S. Pat. No. 5,662,403 A, the applicant has found that the optimum sparkle occurs at much higher luminance values, typically around $10^5$ cd/m$^2$ and not $10^4$ cd/m$^2$, and for much smaller sizes of the sparkling elements, such as smaller than $10^{-6}$ sr, or 3 mm at 3 m viewing distance. At high ambient light levels, which are not uncommon for interior lighting applications, the element needs to be both brighter, such as about 200-300 kcd/m$^2$, and smaller, such as about 1.5 mm diameter, to create a sparkling impression.

Therefore, in an embodiment the luminance of the plurality of sparkling elements is more than 10 kcd/m$^2$ and less than 5 Mcd/m$^2$.

Furthermore, in some embodiments, being particularly useful for outdoor lighting applications, the smallest dimension of each sparkling element of the plurality of sparkling elements is less than 9 mm or less than 4.5 mm. This takes into account the fact that for outdoor lighting applications the viewing distance is typically larger as compared to indoor applications. Also, the experiments conducted by the applicant have shown that a smallest dimension of less than 9 mm is particularly advantageous in a dark outdoor environment, while a smallest dimension of less than 4,5 mm is particularly advantageous in a bright outdoor environment In other embodiments, being particularly useful for indoor lighting applications, the smallest dimension of each sparkling element of the plurality of sparkling elements is less than 3 mm or less than 1.5 mm.

Further to the above advantages, by providing the sparkling elements with such a small size it is ensured that they do not cause additional glare, but only sparkle. Also, the experiments conducted by the applicant have shown that a smallest dimension of less than 3 mm is particularly advantageous in a dark indoor environment, while a smallest dimension of less than 1,5 mm is particularly advantageous in a bright indoor environment.

In a further embodiment, the smallest dimension of the sparkling elements is more than 0.1 mm.

In an embodiment being particularly useful for indoor lighting applications, the spacing between sparkling elements that are visible from the at least one second direction, or from the same one of the plurality of second directions, is more than 10 mm.

In another embodiment being particularly useful for outdoor lighting applications, the spacing between sparkling elements that are visible from the at least one second direction, or from the same one of the plurality of second directions, is more than 30 mm.

Thereby, a light emitting device is provided with which a sufficient amount of sparkling is obtained, while taking into account the fact that for outdoor lighting applications the viewing distance is typically larger as compared to indoor applications.

Also, if the sparkling elements are closer together, there is a risk that they merge in the eye into a single large blob of light that becomes glary instead of sparkly. The above two embodiments eliminates or reduces this risk.

In an embodiment the plurality of sparkling elements is arranged in a pattern of lines extending in a radial direction from a center of the light exit surface towards an outer circumferential edge of the light exit surface.

Thereby, a light emitting device is provided with which patterns of sparkling elements may be provided. Such patterns include, but are not limited to, a star, a cross and a spiraling pattern. Providing patterns of sparkling elements enhances the sparkle perception due to the fact that sparkling points tend to create a star shape in the lens of the eye or in a camera lens.

In an embodiment the plurality of sparkling elements is configured to emit, in operation of the light emitting device, light in a limited angular range with an intensity cut-off. The intensity cut-off may be provided both in a tangential direction and in a polar direction.

Thereby the effect of the sparkling elements varying in brightness with slight movement of the head of the observer is obtained.

In an embodiment the plurality of sparkling elements is arranged in a pattern that changes randomly or moves radially or moves tangentially in dependence of the viewing direction.

This provides for a light emitting device with a further improved sparkling effect. For instance, if the pattern moves radially in dependence of the viewing direction, the viewer perceives the pattern as growing or shrinking. If the pattern instead moves tangentially in dependence of the viewing direction the viewer perceives the pattern as rotating or spiraling.

The plurality of sparkling elements covers less than 10%, such as less than 5%, of the area of the light exit surface from which light with the peak intensity is emitted in operation of the light emitting device.

Thereby, the effect or impact of the sparkling elements on the peak intensity of the beam emitted by the light emitting device in the first direction is minimized.

In an embodiment the sparkling elements of the plurality of sparkling elements are specular facets. The specular facets may be reflective specular facets, totally internal reflecting specular facets or refractive specular facets.

This provides for a light emitting device with a very simple structure which is easy and cost effective in production, and with which the overall appearance of the light emitting device is affected minimally.

In an embodiment the sparkling elements of the plurality of sparkling elements are provided as protrusions or indentations on either side of a separate transparent cover element arranged at the light exit surface of the light emitting device.

In another embodiment the sparkling elements of the plurality of sparkling elements are provided on a transparent foil arranged at the light exit surface of the light emitting device.

In yet another embodiment the light emitting device comprises an optical element, and wherein the sparkling elements of the plurality of sparkling elements are incorporated in the optical element.

These three embodiments all provide for a light emitting device with a particularly simple structure which is easy and cost effective in production.

Also, providing the sparkling elements of the plurality of sparkling elements on a transparent foil provides the further advantage of enabling easy and simple retrofitting of existing light emitting devices not having any sparkling elements according to the invention.

In an embodiment the intensity in the at least one second direction is less than 1% of the peak intensity in the first direction.

In an embodiment the light emitted by the light emitting device, when in operation, comprises an intensity cut off in a plurality of second directions.

Both these embodiments provide for a light emitting device with which the central high intensity beam emitted in the first direction is particularly well defined, while, when combined with sparkling elements still achieving the above-mentioned advantages.

In an embodiment at least two sparkling elements of the plurality of sparkling elements are visible when observed from a viewing position corresponding to any one of the plurality of second directions.

Thereby, the above-mentioned advantages related to the observer of the light emitting device are obtained irrespective of which of the plurality of second directions from which the observer views and moves closer to the light emitting device.

The invention furthermore, in a second aspect, concerns a lamp, a luminaire or a lighting fixture comprising a light emitting device according to the invention. Non-limiting examples of such lamps, luminaires and lighting fixtures are spot lights, accent lighting devices, street lighting devices, automotive lighting devices, head lights and tail lights.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
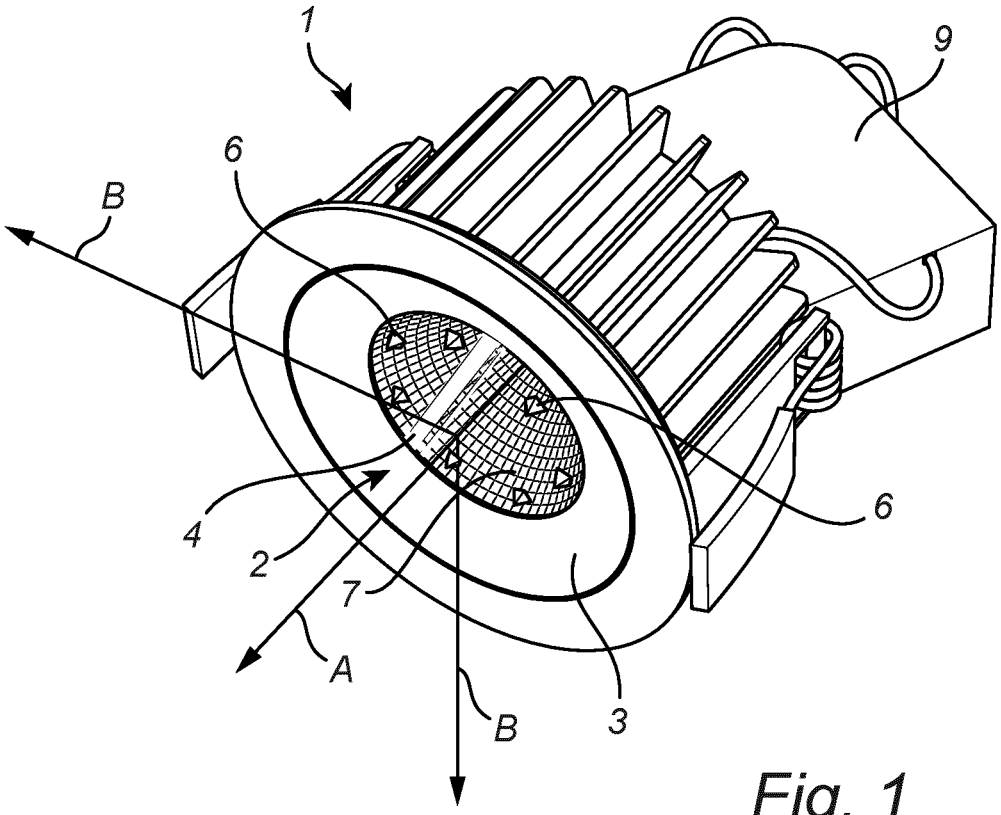
FIG. 1 shows a perspective view of a lighting device comprising a light emitting device according to the invention.

FIG. 1 shows a perspective view of a directional lighting device 1. In the embodiment shown the lighting device 1 is a spotlight. The lighting device may also be provided as, for example, an accent lighting device, a street lighting device, an automotive lighting device, a head light or a tail light.

The lighting device 1 comprises a housing 3, a fixture 9 adapted for connection to a power source, a reflector 7 and a light emitting device 2 according to the invention.

Generally, and irrespective of the embodiment, the light emitting device 2 comprises at least one light source 5 (not visible on FIG. 1, cf. instead FIGS. 11-13) and a plurality of sparkling elements 6. The light emitting device 2 may furthermore comprise a cover element 4 and/or one or more optical elements 8 (cf. FIGS. 11-13). The cover element 4 is a transparent cover element. A surface of the cover element 4 facing the exterior of the light emitting device 2 forms a light exit surface 41 of the light emitting device 2. The at least one light source 5 may be an LED, a light bulb or any other feasible light source.

Generally, and irrespective of the embodiment, the light emitting device 2 is configured to provide a light output at the light exit surface 41. The light output comprises at least one peak intensity in a first direction A and an intensity cut-off in one or more second directions B. The intensity in the one or more second direction B is less than 10% of the peak intensity in the first direction A. Thus, the first direction A is different from the second direction B. Embodiments where the intensity cut-off is provided in more than one second direction B for instance include, but are not limited to, two, three or four different second directions, a range or a plurality of second directions, as well as all directions being rotationally symmetric around the first direction A.

Generally, and irrespective of the embodiment, the plurality of sparkling elements 6 are arranged in the optical path of at least some of the light emitted by the light source 5. The plurality of sparkling elements 6 are furthermore configured and arranged in such a manner that they are visible in the at least one second direction B.

The plurality of sparkling elements 6 may furthermore optionally be configured and arranged in such a manner that they are substantially or completely invisible in the first direction A. If an observer looks at the light emitting device 2 from the first direction A, the exit window will be very bright. In this connection "invisible" may be understood in at least the two following ways. The plurality of sparkling elements 6 may be invisible in the sense that the sparkling elements 6 are equally bright, or in the sense that the sparkling elements are relatively dark compared to the brightness as perceived by the observer looking at the light emitting device 2 from the first direction A.

Alternatively, "invisible" may be understood as follows. The plurality of sparkling elements 6 are no longer sparkly when viewed from the first direction A, because they are comparable in brightness or less bright than the large part of the exit window, when viewed from the first direction A. The largest part of the exit window is "flashed", i.e. it lights up at high brightness, when viewed from direction A. When viewed from direction B, the exit window is either dim, or it contains a few small bright regions. If the large part of the exit window is bright, the sparkling elements are not seen as separate bright elements, but merge in the eye to form a single large bright (and glary) area.

FIGS. 2-5 show different embodiments of the sparkling elements 6 of a light emitting device 2 according to the invention, all with a cover element 4 comprising a plurality of sparkling elements 6. Generally, the cover element 4 comprises a surface 41 adapted for, in the mounted condition, facing the exterior of the light emitting device 2, a surface 42 adapted for, in the mounted condition, facing the interior of the light emitting device 2, a circumferential edge 43 and a center 44. The surface 41 of the cover element 4 forms or coincides with the light exit surface 41 of the light emitting device 2.

Figure 2:
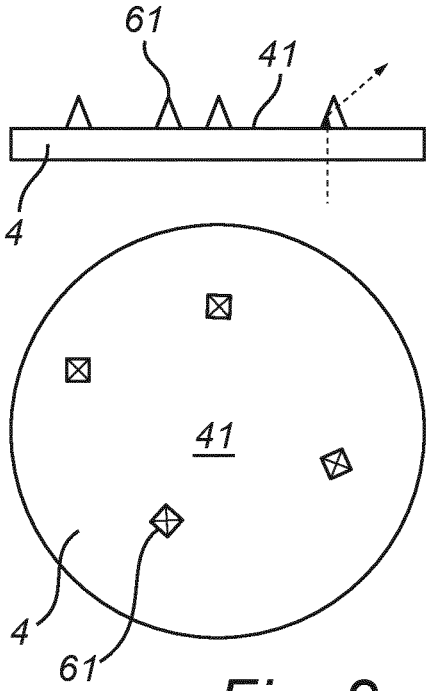
FIG. 2 shows a first embodiment of a cover element or a foil element comprising sparkling elements of a light emitting device according to the invention in a side view and a top view, respectively.

FIG. 2 shows a first embodiment of a light emitting device 2 according to the invention in a side view and a top view, respectively. For the sake of simplicity only the cover element 4 and the sparkling elements 61 are shown. In this embodiment four sparkling elements 61 are provided. The four sparkling elements 61 are provided as pyramid-shaped protrusions comprising facets with total internal reflection (TIR facets). The protrusions are provided on the surface 41 of the cover element 4 and face, in the mounted condition of the cover element 4, towards the exterior of the light emitting device 2. The pyramid-shaped protrusions may have any polygonal base, such as, but not limited to, triangular, square, pentagonal and so forth.

In this embodiment the sparkling elements 61 may also be provided on a foil attached to the surface 41 of the cover element 4.

Figure 3:
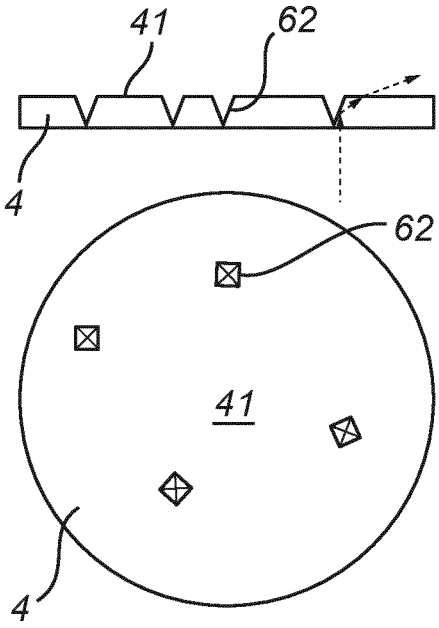
FIG. 3 shows a second embodiment of a cover element or a foil element comprising sparkling elements of a light emitting device according to the invention in a side view and a top view, respectively.

FIG. 3 shows a second embodiment of a light emitting device 2 according to the invention in a side view and a top view, respectively. The light emitting device shown in FIG. 3 differs from that described in relation to FIG. 2 in that the four sparkling elements 62 are provided as pyramid-shaped indentations comprising facets with total internal reflection (TIR facets). The indentations extend from the surface 41 of the cover element 4 towards the surface 42 if the cover element 4. In the mounted condition of the cover element, the indentations extend towards the interior of the light emitting device 2.

Figure 4:
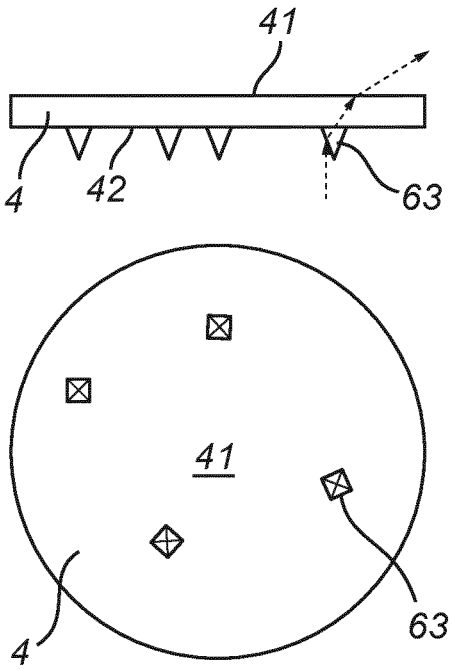
FIG. 4 shows a third embodiment of a cover element or a foil element comprising sparkling elements of a light emitting device according to the invention in a side view and a top view, respectively.

FIG. 4 shows a third embodiment of a light emitting device 2 according to the invention in a side view and a top view, respectively. The light emitting device shown in FIG. 4 differs from those described in relation to FIGS. 2-3 in that the four sparkling elements 63 are provided as refractive pyramid-shaped protrusions. The protrusions are provided on a surface 42 opposite to and parallel with the surface 41 and face, in the mounted condition of the cover element 4, towards the interior of the light emitting device 2.

In this embodiment the sparkling elements 63 may also be provided on a foil attached to the surface 42 of the cover element 4.

Figure 5:
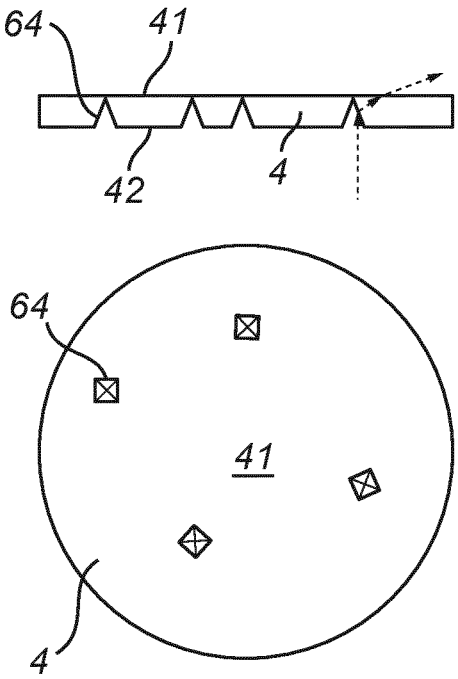
FIG. 5 shows a fourth embodiment of a cover element or a foil element comprising sparkling elements of a light emitting device according to the invention in a side view and a top view, respectively.

FIG. 5 shows a fourth embodiment of a light emitting device 2 according to the invention in a side view and a top view, respectively. The light emitting device shown in FIG. 5 differs from those described in relation to FIGS. 2-4 in that the four sparkling elements 64 are provided as refractive pyramid-shaped indentations. The indentations extend from a surface 42 opposite to and parallel with the surface 41 towards the surface 41. In the mounted condition of the cover element 4, the indentations face towards the exterior of the light emitting device 2.

Turning now towards FIGS. 6-10, top views of different embodiments of the pattern in which the sparkling elements may be arranged is shown.

Figure 6:
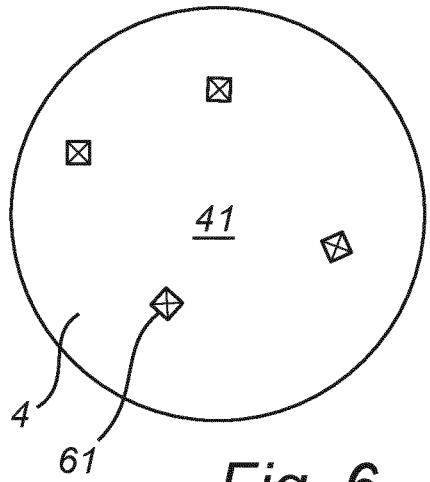
FIG. 6 shows a top view of a fifth embodiment of a cover element or a foil element comprising sparkling elements of a light emitting device according to the invention.

FIG. 6 shows sparkling elements 61 of any of the types described above in relation to FIGS. 2-5 arranged in a random pattern.

Figure 7:
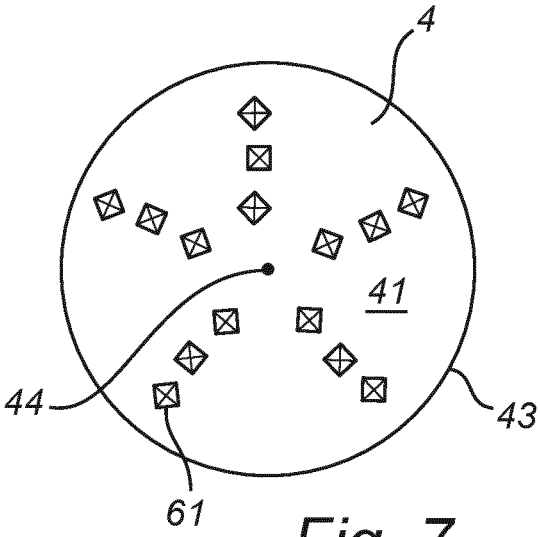
FIG. 7 shows a top view of a sixth embodiment of a cover element or a foil element comprising sparkling elements of a light emitting device according to the invention.

FIG. 7 shows sparkling elements 61 of any of the types described above in relation to FIGS. 2-5 arranged in a pattern comprising straight lines of sparkling elements 61. As shown on FIG. 7, the lines extend from a center 44 of the cover element 4 towards an outer circumferential edge 43 of the cover element 4. Alternatively, the pattern may comprise curved lines of sparkling elements 61 and/or the lines may extend in a direction different from that shown on FIG. 7, for instance around the center 44 of the cover element 4.

Figure 8:
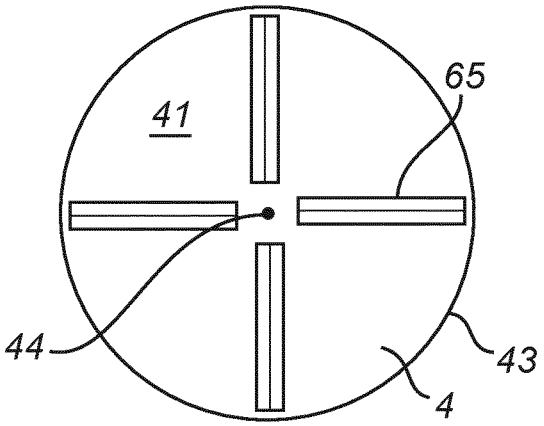
FIG. 8 shows a top view of a cover element or a foil element comprising sparkling elements of a seventh embodiment a light emitting device according to the invention.

FIG. 8 shows sparkling elements 65 in the form of linear structures being V-shaped in cross-section. The sparkling elements 65 are arranged such as to extend from a center 44 of the cover element 4 towards an outer circumferential edge 43 of the cover element 4.

Figure 9:
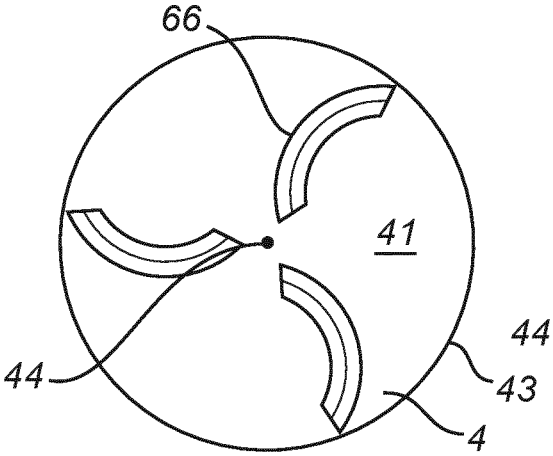
FIG. 9 shows a top view of a cover element or a foil element comprising sparkling elements of an eighth embodiment of a light emitting device according to the invention.

FIG. 9 shows sparkling elements 66 in the form of curvilinear structures being V-shaped in cross-section. The sparkling elements 66 are arranged such as to extend in a curve from a center 44 of the cover element 4 towards an outer circumferential edge 43 of the cover element 4.

Figure 10:
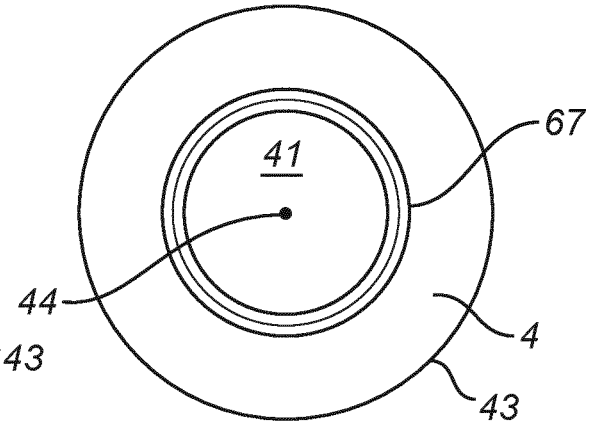
FIG. 10 shows a top view of a ninth embodiment of a cover element or a foil element comprising sparkling elements of a light emitting device according to the invention.

FIG. 10 shows a plurality of sparkling elements arranged to form a curvilinear structure 67 being V-shaped in cross-section. The plurality of sparkling elements are arranged such as to extend in a circle around and concentric with a center 44 of the cover element 4. The plurality of sparkling elements forming the curvilinear structure 67 may for instance be of the type shown in FIG. 8 or of the type shown in any of FIGS. 2-7. In principle, the curvilinear structure 67 may also be provided as one sparkling element.

In any one of the embodiments shown in FIGS. 6-10, the sparkling elements may also be provided on a foil attached to the surface 42 of the cover element 4.

Alternatively, the sparkling elements 6 may also be incorporated in an optical element 8 of the light emitting device 2. This is illustrated in the embodiments shown in FIGS. 11-13, in which only the optical element 8 and the sparkling elements 6 are shown for the sake of simplicity. Each of FIGS. 11-13 also illustrate the light source 5 and arrows symbolizing the optical path of some of the light emitted by the light source 5. All three embodiments are based on an optical element 8 in the form of a TIR collimator. The TIR collimator comprises a light exit surface 81, a cavity or indentation 83 in which the light source 5 of the light emitting device 2 is arranged and a circumferential wall 82 extending between the surface 81 and the cavity 83.

For optical elements 8 in the form of TIR Fresnel lenses, similar embodiments can be envisaged. Also, embodiments based on optical elements 8 in the form of refractive lenses or reflectors may be feasible. In any case, for embodiments with the sparkling elements 6 incorporated in an optical element 8 of the light emitting device, a separate cover element 4 may be omitted.

Figure 11:
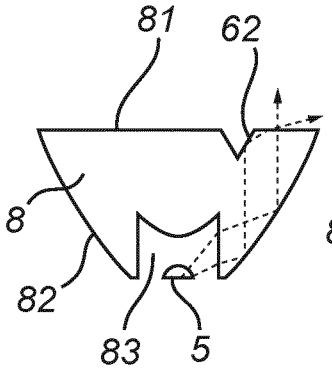
FIG. 11 shows a cross-sectional view of a tenth embodiment of a light emitting device according to the invention with sparkling elements incorporated in an optical element of the light emitting device.

FIG. 11 shows an embodiment in which a TIR collimator 8 comprises sparkling elements 62 provided as pyramid-shaped indentations comprising facets with total internal reflection (TIR facets). The indentations extend from the surface 81 of the TIR collimator 8 forming the light exit surface of the light emitting device 2 towards the interior of the TIR collimator 8 and thus the interior of the light emitting device. Alternatively, the sparkling elements may be provided as pyramid-shaped protrusions comprising facets with total internal reflection (TIR facets).

Figure 12:
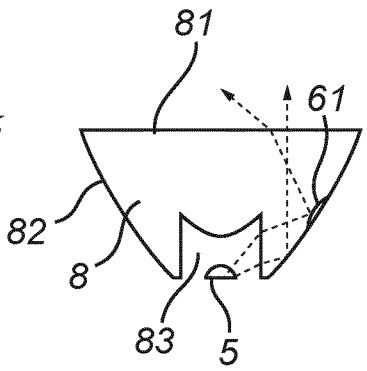
FIG. 12 shows a cross-sectional view of an eleventh embodiment of a light emitting device according to the invention with sparkling elements incorporated in an optical element of the light emitting device.

FIG. 12 shows an embodiment in which a TIR collimator comprises sparkling elements 61 provided as pyramid-shaped protrusions comprising facets with total internal reflection (TIR facets). The protrusions extend from the circumferential surface 82 of the TIR collimator 8 towards the interior of the TIR collimator 8. Alternatively, the protrusions may extend from the circumferential surface 82 of the TIR collimator 8 towards the exterior of the TIR collimator 8.

Figure 13:
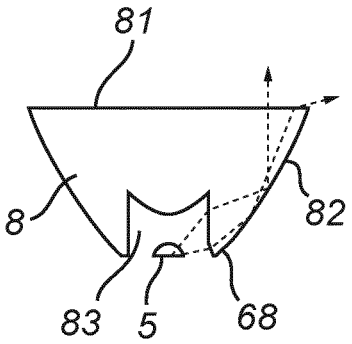
FIG. 13 shows a cross-sectional view of a twelfth embodiment of a light emitting device according to the invention with sparkling elements incorporated in an optical element of the light emitting device.

FIG. 13 shows an embodiment in which a TIR collimator comprises sparkling elements 68 provided as deviating refractive facets at the light entrance of the TIR collimator.

The protrusions are arranged such as to form a transition between the circumferential surface 82 of the TIR collimator 8 and the cavity 83 of the TIR collimator 8.

Of course, providing sparkling elements of any of the embodiments described in connection with FIGS. 2-10 on an optical element 8 of a light emitting device 2 according to the invention is also feasible.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A luminaire comprising a light emitting device, the light emitting device comprising a light exit surface and at least one light source configured to, in operation, emit light, the light emitting device being configured to provide a light output at the light exit surface, the light output comprising at least one peak intensity in a first direction (A) and an intensity cut-off in at least one second direction (B), where the intensity in the at least one second direction is less than 10% of the peak intensity in the first direction, wherein the light emitting device comprises a plurality of sparkling elements arranged in the optical path of at least a part of the light emitted by the at least one light source, wherein the plurality of sparkling elements is provided at, in or on the light exit surface, wherein the sparkling elements of the plurality of sparkling elements are any one or more of point like, linear or curved linear, or wherein the sparkling elements of the plurality of sparkling elements are specular facets, wherein at least two sparkling elements of the plurality of sparkling elements are configured and arranged to be visible when observed from a viewing position corresponding to the at least one second direction (B), and wherein the sparkling elements of the plurality of sparkling elements are any one or more of point like, linear or curved linear, or wherein the sparkling elements of the plurality of sparkling elements are specular facets.

2. A luminaire according to claim 1, wherein the luminance of the plurality of sparkling elements is more than 10 kcd/$m^2$ and less than 5 Mcd/$m^2$.

3. A luminaire according to claim 1, wherein the light emitted by the light emitting device, when in operation, comprises an intensity cut off in a plurality of second directions (B).

4. A luminaire according to claim 3, wherein at least two sparkling elements of the plurality of sparkling elements are visible when observed from a viewing position corresponding to any one of the plurality of second directions (B).

5. A luminaire according to claim 1, wherein the smallest dimension of each sparkling element of the plurality of sparkling elements is less than 9 mm or less than 4.5 mm and the spacing between sparkling elements that are visible from the at least one second direction, or from the same one of the plurality of second directions, is more than 30 mm, or wherein the smallest dimension of each sparkling element of the plurality of sparkling elements is less than 3 mm or less than 1.5 mm, and the spacing between sparkling elements that are visible from the at least one second direction, or from the same one of the plurality of second directions, is more than 10 mm.

6. A luminaire according to claim 1, wherein the plurality of sparkling elements is arranged in a pattern of lines extending in a radial direction from a center of the light exit surface towards an outer circumferential edge of the light exit surface.

7. A luminaire according to claim 1, wherein the plurality of sparkling elements is configured to emit, in operation of the light emitting device, light in a limited angular range with an intensity cut-off.

8. A luminaire according to claim 1, wherein the plurality of sparkling elements is arranged in a pattern that, when observed by an observer, changes randomly or moves radially or moves tangentially in dependence of the viewing direction.

9. A luminaire according to claim 1, wherein the plurality of sparkling elements cover less than 10% or less than 5% of the area of the light exit surface from which light with the peak intensity is emitted in the first direction (A) in operation of the light emitting device.

10. A luminaire according to claim 1, wherein the sparkling elements of the plurality of sparkling elements are provided on a transparent foil arranged at the light exit surface of the light emitting device.

11. A luminaire according to claim 1, wherein the intensity in the at least one second direction (B) is less than 1% of the peak intensity in the first direction.

* * * * *